US008272477B1

(12) United States Patent
Hudspeth et al.

(10) Patent No.: US 8,272,477 B1
(45) Date of Patent: Sep. 25, 2012

(54) FIRE RESISTANT FOLDABLE STOWED STAIR ASSEMBLY

(76) Inventors: Bradley F. Hudspeth, Memphis, TN (US); Morris F. Hudspeth, Cordova, TN (US); Samuel L. Daniel, Olive Branch, MS (US); John C. Halbach, Marion, AR (US); Frank B. Abbadessa, Collierville, TN (US)

( * ) Notice: Subject to any disclaimer, the term of this patent is extended or adjusted under 35 U.S.C. 154(b) by 646 days.

(21) Appl. No.: 11/934,525

(22) Filed: Nov. 2, 2007

(51) Int. Cl.
*E06C 9/00* (2006.01)
*E04F 11/04* (2006.01)

(52) U.S. Cl. ..... 182/77; 182/78; 182/81; 49/1

(58) Field of Classification Search ..... 182/77, 182/78, 81; 49/1
See application file for complete search history.

(56) References Cited

U.S. PATENT DOCUMENTS

| | | | | | |
|---|---|---|---|---|---|
| 2,045,367 | A | * | 6/1936 | Porter | 160/1 |
| 2,196,781 | A | * | 4/1940 | Saino et al. | 52/783.17 |
| 2,321,499 | A | * | 6/1943 | Marschke | 182/81 |
| 2,853,394 | A | * | 9/1958 | Riddell et al. | 106/675 |
| 3,501,323 | A | * | 3/1970 | Moorehead | 264/211.11 |
| 3,590,540 | A | * | 7/1971 | Johnson et al. | 52/309.13 |
| 3,987,600 | A | * | 10/1976 | Baehr | 428/119 |
| 4,159,302 | A | * | 6/1979 | Greve et al. | 264/333 |
| 4,299,059 | A | * | 11/1981 | Smith | 49/401 |
| 4,530,877 | A | * | 7/1985 | Hadley | 428/305.5 |
| 4,541,208 | A | * | 9/1985 | Vesperman et al. | 52/19 |
| 4,559,881 | A | * | 12/1985 | Lankard et al. | 109/83 |
| 4,699,822 | A | * | 10/1987 | Shu | 428/198 |
| 4,799,349 | A | * | 1/1989 | Luckanuck | 52/784.11 |
| 5,050,706 | A | * | 9/1991 | Cole et al. | 182/78 |
| 5,239,795 | A | * | 8/1993 | Breaux | 52/182 |
| 5,391,245 | A | * | 2/1995 | Turner | 156/39 |
| 5,401,793 | A | * | 3/1995 | Kobayashi et al. | 524/401 |
| 5,554,433 | A | * | 9/1996 | Perrone et al. | 428/192 |
| 5,685,903 | A | * | 11/1997 | Stav et al. | 106/735 |
| 5,718,759 | A | * | 2/1998 | Stav et al. | 106/735 |
| 6,131,702 | A | * | 10/2000 | Berridge | 187/259 |
| 6,363,867 | B1 | * | 4/2002 | Tsilevich | 109/49.5 |
| 6,425,211 | B1 | * | 7/2002 | Wise et al. | 52/1 |
| 6,615,544 | B1 | * | 9/2003 | Tlemcani et al. | 49/7 |
| 6,660,190 | B2 | * | 12/2003 | Huhn | 252/602 |
| 7,028,431 | B2 | * | 4/2006 | Tlemcani et al. | 49/8 |
| 2004/0045219 | A1 | * | 3/2004 | Tlemcani et al. | 49/7 |

* cited by examiner

*Primary Examiner* — Alvin Chin Shue
*Assistant Examiner* — Colleen M Chavchavadze
(74) *Attorney, Agent, or Firm* — Wyatt, Tarrant & Combs, LLP; William S. Parks

(57) ABSTRACT

Novel stowed staircases for attics and the like that exhibit highly effective fireproof properties are provided. The combination of sheet metal well sides with ceramic paper covering, a combination thermal board and cement-like construction door, coupled with a sealed gasket at the interface of the stair bottom with the ceiling provide the necessary long-term fireproof capabilities as well as facilitation in installation as a sufficiently lightweight article. In such a manner, the inventive stairway construction may be easily incorporated within a residential or other type unit to aid in the simultaneous accessibility to an attic (or like location) and ability to prevent fire from easily spreading into or out of said attic via the stair assembly itself.

13 Claims, 5 Drawing Sheets

FIRE RESISTANT FOLDABLE STOWED STAIR ASSEMBLY

FIELD OF THE INVENTION

The subject invention relates to novel stowed staircases for attics and the like that exhibit highly effective fireproof properties. The combination of sheet metal well sides with ceramic paper covering, a combination thermal board and cement-like construction door, coupled with a sealed gasket at the interface of the stair bottom with the ceiling provide the necessary long-term fireproof capabilities as well as facilitation in installation as a sufficiently lightweight article. In such a manner, the inventive stairway construction may be easily incorporated within a residential or other type unit to aid in the simultaneous accessibility to an attic (or like location) and ability to prevent fire from easily spreading into or out of said attic via the stair assembly itself.

BACKGROUND OF THE INVENTION

Fireproof and/or resistant characteristics are highly desirable for residential homes. As most dwellings are constructed of wood materials, particularly the underlying structure thereof, such edifices are susceptible to rapid destruction if a fire is present. As such, certain localities and even states have enacted building codes for home residences that require a certain degree of fire and/or flame resistance in order to permit sufficient time for escape or potentially for actual extinguishing of a fire within the subject building. Wallboard, ceiling materials, carpets, flooring, oriented strand board, wall and floor joists have all been accorded to some degree a level of fire and/or flame resistance to meet these requirements. However, although such dwelling building materials and components have been manufactured with certain fireproof and/or fire resistance properties (such as with certain coatings on wood materials, certain hard-to-burn wallboards, and the like), there has not been an effective foldable stowing stairway with such necessary and desirable qualities.

Foldable stowing stairways, which may be folded upwardly into the ceiling or towards another elevated level or surface, have been used in residential homes for many years (for access to attic space, for instance). Such stairways are advantageous because they allow a stair to be folded out of the way when space concerns are present, so that the stair no longer occupies floor space on the lower floor or other surface from which a user wishes to ascend. Such stairways essentially amount to articulated ladders wherein the siderails of the ladders are jointed to allow them to be folded up, and then the folded siderails may themselves be folded between opposing joists of a ceiling to full stowage.

Such foldable stowing stairways appear to be a weak link in the fire protection desired within such a dwelling. Even if the walls, ceilings, joists, floors, etc., are provided in a fire resistant state, the cut-out opening through which the stairway is commonly attached may act as an unwanted conduit of heat and flames thus potentially exacerbating the situation were a fire to be present. As such, it seems imperative that an effectively fire and/or flame resistant foldable stowing stairway, particularly one that will provide the same general level of fire protection as the other dwelling building components and materials would accord greater reliability to the homebuilder, not to mention the resident and the insurer.

To date, the only known article provided with any such fire resistance rating is of all-metal construction, specifically from aluminum (as such is a lightweight metal permitting ease in installation from a weight perspective). Although such a metal provides well-known and effective staircase functions, in terms of high temperature exposure such a material lacks the ability to remain dimensionally stable when the melting point thereof has been exceeded. Since aluminum does not exhibit a sufficiently high melting temperature to meet the requirements of the pertinent and accepted ANSI tests and ASTM test methods for dwellings, it is not a stretch to deduce that upon actual use, were a fire to ignite in a subject dwelling including such an apparatus, the metal portions thereof may expand, detach, or distort from the ceiling (or floor) thereby creating the potential hazard noted above. An improved construction that would not only function properly as a pulldown stairway as well as accord fire protection and proofing simultaneously would be highly desirable for the residential building industry. As of today, there have been no such improvements accorded this industry.

BRIEF DESCRIPTION OF THE INVENTION

Accordingly, this invention encompasses a foldable stowing stairway that exhibits at least one hour of fire resistance when tested under ASTM Test Method No. E119, wherein said stairway comprises 1) at least three stair sections, each connected to another via a hinge, 2) a platform door upon which said at least three stair sections are placed upon when said stairway is in stowed position, wherein said platform door comprises at least two different sheet materials. Such a specific stairway must include a number of components in order to provide the desired fire proofing properties. For example, not only must the stairway exhibit no gaps between the ceiling and the folded support platform upon which the stairway itself is disposed when the platform is in closed position (and thus the stairway is in stowed position), the distance between the stairway frame that is disposed between joists within the ceiling (or floor, depending on the perspective of the viewer) must be sufficiently small to permit effective sealing as well. In such a manner, the ability for flame or heat to transfer through the openings of the cut-out portion of the subject ceiling (or floor) is drastically reduced. Furthermore, the seal between these openings must be filled with a suitably high melting point sealing material to accord the necessary level of protection.

As every portion of the stairway must be viewed as a potential weak link to fire and/or flame transfer between building levels, it was imperative to develop a stairway assembly that addresses each such potential opening as well as each and every material utilized within the stairway construction. As such, more than just the openings must be considered when considering the level of fire protection required. The selection of proper materials for each component was thus necessary as well from both fire resistance and ease-in-installation standpoints. In terms of the stairs themselves, however, any type of material was available as long as such a component functioned properly to bear the weight of a person when in use as a stairway, particularly since the stairs themselves are not a barrier between building levels in such a foldable stowed stairway configuration. Thus, wood, plastic (of any type of polymer), and metal materials may be utilized in that portion. The platform (door) that supports such stairs, however, was developed with a number of parameters in mind. In particular, the capability to hold not only the stairs themselves when in stowed position, but also to potentially bear the weight of the stairs when in use had to be considered (not to mention a lightweight construction for facilitating installation, too). Beyond that, since such a component would be in the direct line of a flame potentially when in a building, particularly when the fire ignites in an area below such a stowed stairway, the platform must also exhibit sufficiently high fire resistance on its own.

As noted above, this platform must seal against the ceiling and the frame (also known as well sides) upon stowing and should not permit any appreciable heat and/or flame to transfer through the openings in the cut-out portion of the subject ceiling should a fire be present. To that end, a metal envelope was developed and applied around the periphery of the platform door with the aforementioned high melting point material applied thereto. It is thus also desirable that the spring facilitating opening and closing of the platform door (and thus permitting the folded stairway to be lowered easily for use) be of sufficient tension to close the platform to the degree necessary for a sealed relation to be present as well. It is the possibility of a lack of sufficient tension, however, that the inventive stairway includes the sealing material; in essence, as a further line of defense for the prevention of heat and/or flame transfer through the above-described ceiling cut-out openings. Such a cut-out portion of a ceiling (or floor) could act as a chimney-like apparatus, providing a capability of increasing the size and severity of a fire, rather than diminishing its strength. Thus, the reduction of potential areas of heat and/or flame transfer through openings big or small is of great necessity. To that end, sealing the areas between the frame in which the folded stairway is stowed within the ceiling itself and the floor (or ceiling) joists is also of great importance. The walls of such a frame (again, also referred to as well sides of the stairway in the industry) should be made from materials that can withstand the high temperatures associated with residence fires (e.g. 1700° F. or 927° C.). Preferably, such materials are either metal (such as steel) or wood, and is further coated and/or wrapped with a flame retardant and/or fire resistant material (such as a ceramic paper). Most preferably, this frame material is steel.

Basically, the inventive stairway provides effective fire resistance at every vulnerable location for heat and/or flame transfer between building levels. Such a result is quite difficult to accomplish, particularly with materials and components that must facilitate installation thereof with simultaneous effective fire and/or flame resistance. The materials and components themselves are of highly critical construction to meet all of these required characteristics. If an all-metal construction were utilized, either the type of metal used would be suspect from a fire resistance perspective, though light enough in weight to permit relatively easy installation (such as aluminum, as discussed previously). If an all-wood construction were desired, the treatments needed for coating all of the materials for proper fire resistance would be extremely high in cost, and the openings in ceiling cut-out would be highly susceptible to the aforementioned problems. If an all-plastic construction were present, weight issues may be met, but high temperature problems would most likely ensue. As such, the ability to provide the desired installation facilitation and fire resistance properties was surprisingly met, particularly for a foldable stowing stairway that exhibits such a high degree of fireproofing.

DETAILED DESCRIPTION OF THE DRAWINGS AND PREFERRED EMBODIMENTS OF THE INVENTION

Figure 1:
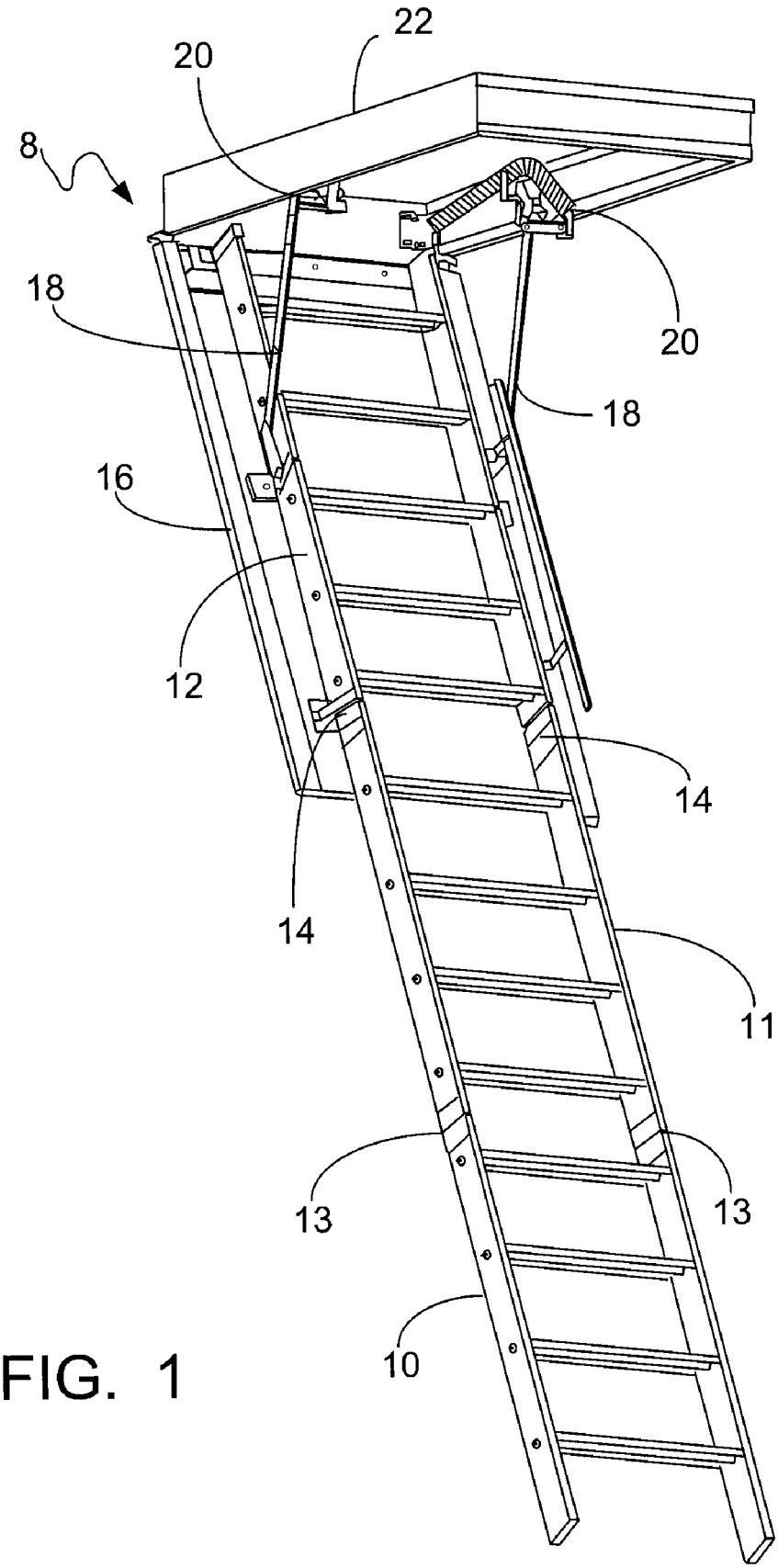
FIG. 1 provides a front profile view of a foldable stairway located in a ceiling cut-out in the open position.

In FIG. 1, thus, the foldable stairway 8 is shown to consist of three stair sections, a lower section 10, a central section 11, and an upper section 12. As noted above, each section of stairs may be made from any acceptable material that may bear the weight of a user and can be provided in plank forms to form the individual stairs thereof. Thus, sufficiently strong wood, plastic, and/or metal may be utilized for such a purpose. Wood and/or aluminum are preferred due to such materials' lightweight and strength characteristics (if wood, such types as pine, oak, cedar, and the like, may be selected for such a purpose, as merely some non-limiting examples) for installation facilitation. Such stair sections 10, 11, 12 are foldable due to two sets of hinges 13, 14, one present as a connection between the lower section 10 and central section 11 (namely 13), and the other present as a connection between the central section 11 and upper section 12 (namely 14). Such hinges are preferably metal in construction (such as steel, as one example) or possibly plastic (such as fiberglass, nylon, or other material that can withstand exposure to high temperatures and flame as well as can withstand the continued opening and closing of the subject stairway). When in the open position as shown, the stair sections 10, 11, 12 the stairway is present at an angle that facilitates climbing for a user; such an angle is preferably from 60 to 80 degrees from the floor of the level to which the stairway is lowered. The upper section 12 is attached to and disposed on a platform 16 when in the open or closed position. When in the closed position (such as in FIG. 2), the entire stairway (consisting of all three sections 10, 11, 12) rest upon this platform. The platform door 16 is opened and closed while attached to the ceiling (110 of FIG. 2) through a piano hinge (114 of FIG. 2). In order to prevent the platform 16 from opening too wide (and thus to prevent the sections of the stairway 10, 11, 12 from properly contacting the lower level (not illustrated) a pair of spring arms 18 are present, attached to a pair of springs 20 that provide tension to permit opening of the platform door 16 at a sufficiently slow rate to prevent injury to the user as well as to provide sufficient strength to keep the overall foldable stairway in a stowed position when the platform door 16 is closed. A frame 22 is provided to aid in installing the all-in-one constructed stairway article 8 within a ceiling cut-out (110 in FIG. 2) which is secured within such an area via attachment to joists present therein (not illustrated). The walls of the frame 22 may be constructed of any suitable material, as noted above, as long as such material permits facilitation of installing the stairway article 8 within a dwelling (i.e., is lightweight) and can withstand closing of the platform door 16 upon tensioning of the springs 20. As such springs 20 may apply force via such tensioning that the platform door 16 and stair sections 10, 11, 12 may close very quickly, the overall construction of the frame 22 should reflect an ability to remain dimensionally stable once such a potential high-tension closing is permitted by the user as well. Wood or metal (such as steel) is preferred. To such a preferred material, however, is applied a sufficiently fire retardant coating of fiber (such as paper), fabric, or chemical type since the openings of the ceiling cut-out (the ceiling portion (110 in FIG. 2) will potentially create a conduit for heat and/or flame transfer between building levels when the stairway 8 is in closed, stowed position. Preferably, this frame (or alternatively referred to as the stairway well sides) is covered with a ceramic fiber paper comprising materials such as aluminosilicate fibers in a nonwoven matrix. Most preferably, such a paper is FIBERFRAX® ceramic fiber paper from Unifrax Corporation of Niagara Falls, N.Y.

Figure 2:
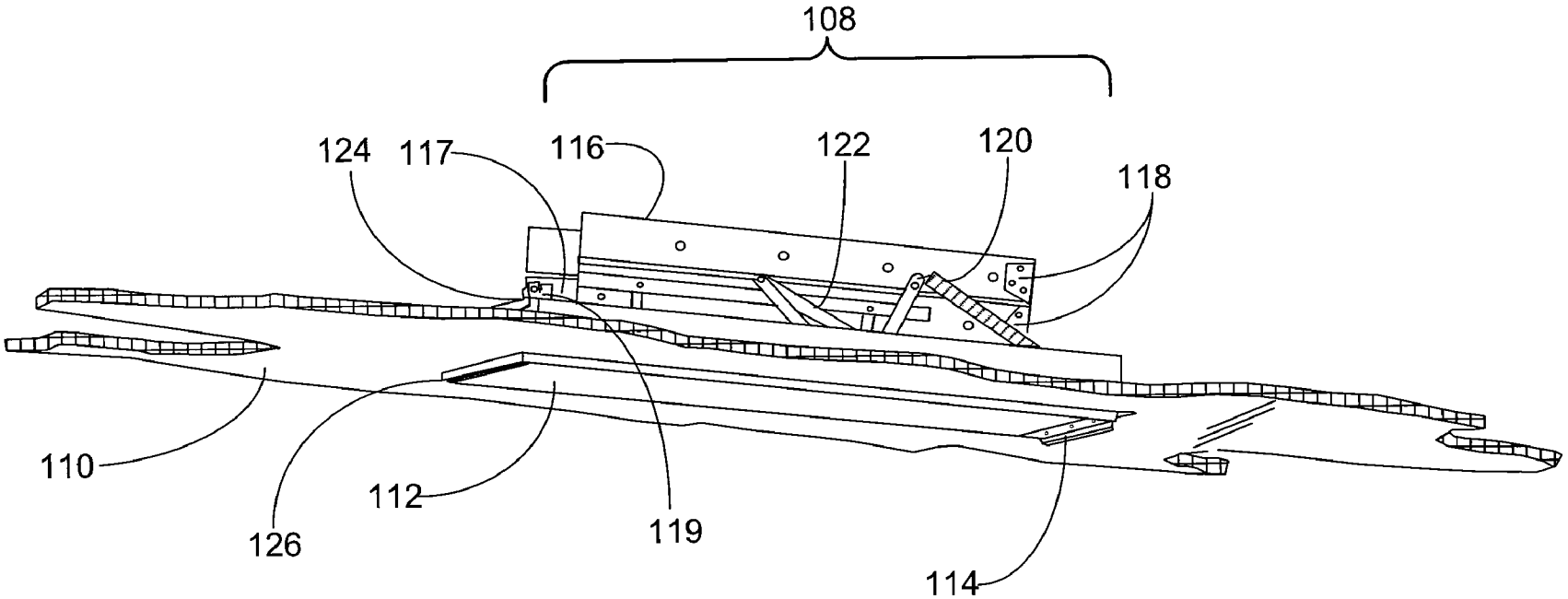
FIG. 2 provides a side view of the foldable stairway in a ceiling cut-out (with a cross-sectional view of said ceiling) in the closed position.

FIG. 2 depicts the closed position of the stairway article 108. The openings in the ceiling 110, particularly at the site of the platform door 112 are noticeable. In its closed position, the lower section of stairs 116 are folded on top of the central section of stairs 117 which are folded on top of the lower section of stairs (219 of FIG. 3). The two sets of hinges 118, 119 permit such folding, again with the aid of the tensioning of two sets of springs 120 and the movement of the set of spring arms 122. As noted in this closed position, the sections of stairs 116, 117 (and 219 of FIG. 3) are disposed on top of the platform door 112. Thus, the platform door 112 must be constructed of sufficiently strong material to bear the weight of those stair sections 116, 117 (and 219 of FIG. 3) when in the stowed, closed position, and also be of sufficiently lightweight material to permit installation easily within the dwelling itself.

Figure 5:
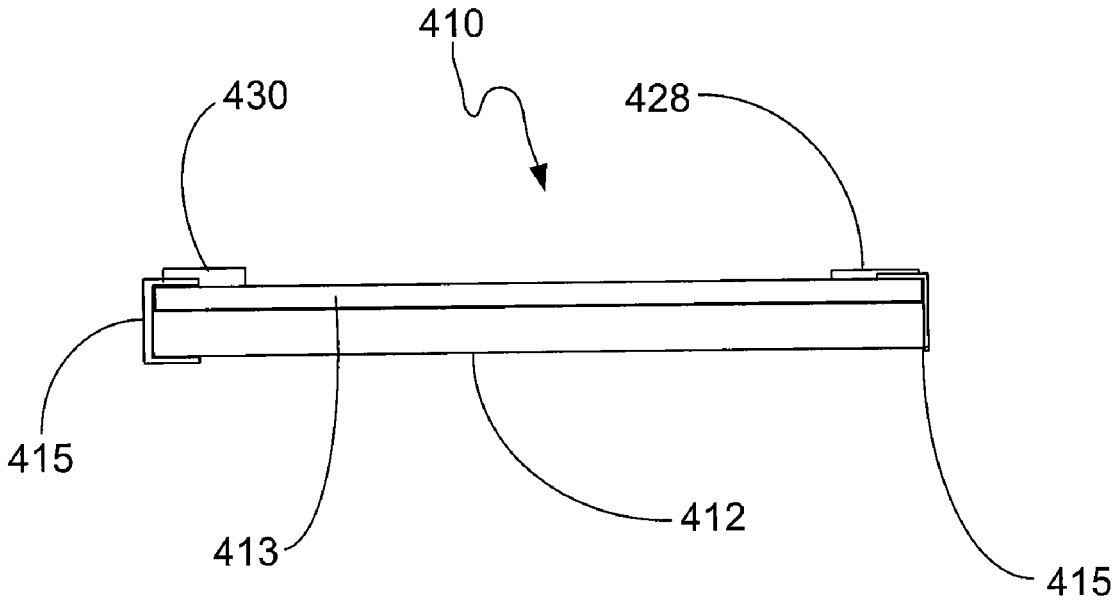
FIG. 5 provides a cross-sectional view of the platform door.

Furthermore, as a barrier between the ceiling 110 and the lower level of the subject edifice (not illustrated), the platform door 112 is the main impediment to any heat and/or flame transfer between such building levels. Thus, the selectivity of materials is of utmost importance for this portion of the stairway assembly 108 (8 of FIG. 1). It was determined that such a platform door 112 required two separate components to provide these required characteristics. As shown in FIG. 5, the cross-section of this platform door 410 has a lower portion 412 and an upper portion 413 that provide the simultaneous strength, resiliency, and fire resistance in combination to the weight-bearing door 410, not to mention the ability to withstand the high tension, potentially quick closings described previously. It was determined that the upper portion 413 required a fiber-reinforced cement panel cut into the necessary shape to permit as complete coverage of the ceiling cut-out as possible when in the closed position and of smaller height than the lower portion 412.

In addition, such a platform door 410 (in its entirety) must also provide an effective temperature barrier to the stairway assembly in stowed position and in place above the ceiling (or floor) that separates the levels of the subject edifice. It is imperative that in order to function properly as a fire resistant article, such a stairway assembly must prevent a temperature in of 400° F. (204.4° C.) from transferring from one level of the subject edifice to the upper or lower level for at least 1 hour. Thus, the materials utilized within such a platform door 410 must also, in addition to the properties noted previously, accord such a specific level of temperature barrier as well.

Preferably, the upper portion 413 of the platform door 410 is a cement-like panel comprised of quartz (or other crystalline silica), hydrated calcium silicate, and cellulose fibers. Products provided by James Hardie Building Products of Mission Viejo, Calif., under the tradename HARDIEPANEL® and HARDIBACKER® are particularly preferred for this purpose. The lower portion 412 is a thicker panel that is comprised of calcium silicate, aluminum silicate, crystalline silica, and cellulose or other like fiber and provides effective insulation from heat and cold as well as flame and fire resistance. Products provided by IIG (Industrial Insulation Group) under the tradename SUPER FIRETEMP M® are particularly preferred for this purpose. These non-limiting materials have surprisingly been found to provide the characteristics noted above simultaneously. The panel of the upper portion may actually be used within the lower portion, and the board of the lower portion may be used within the upper portion, if desired. Preferably, however, the configuration noted above is followed.

Further depicted in FIG. 5, the periphery of at least two opposite edges of the platform door 410 are enveloped on three edges by a metal housing 415. Such a housing 415 thus is in contact with both the lower portion 412 and upper portion 413 of the platform door 410 and aids in keeping such portions 412, 413 in contact as well as provided a resilient seal with the ceiling (not illustrated) when in the closed position. The metal housing 415 may extend beyond the edges of the platform door 410 for such a purpose as well. Steel is preferred for the materials of this metal housing 415. To secure the seal with the ceiling when closed, gasket material 428, 430 is applied to the metal housing and potentially the upper portion 413 of the platform door 410. Such a gasket material 428, 430 must, as noted above, be able to withstand high temperatures associated with dwelling fires and thus provide an effective seal between the platform door 410 and the ceiling (110 in FIG. 2) even during a fire. This gasket material 428, 430 is preferably a ceramic fiber product comprised of vitreous aluminosilicate fiber, such as FIBERFRAX® ceramic paper from Unifrax [the same paper is used for the frame (324 in FIG. 4, for instance) material wrap as well], although any type of gasket material that meets these high temperature, sealant requirements may be utilized in such a capacity (preferably without any environmental discharges or releases upon spray or other type application, as well).

Figure 4:
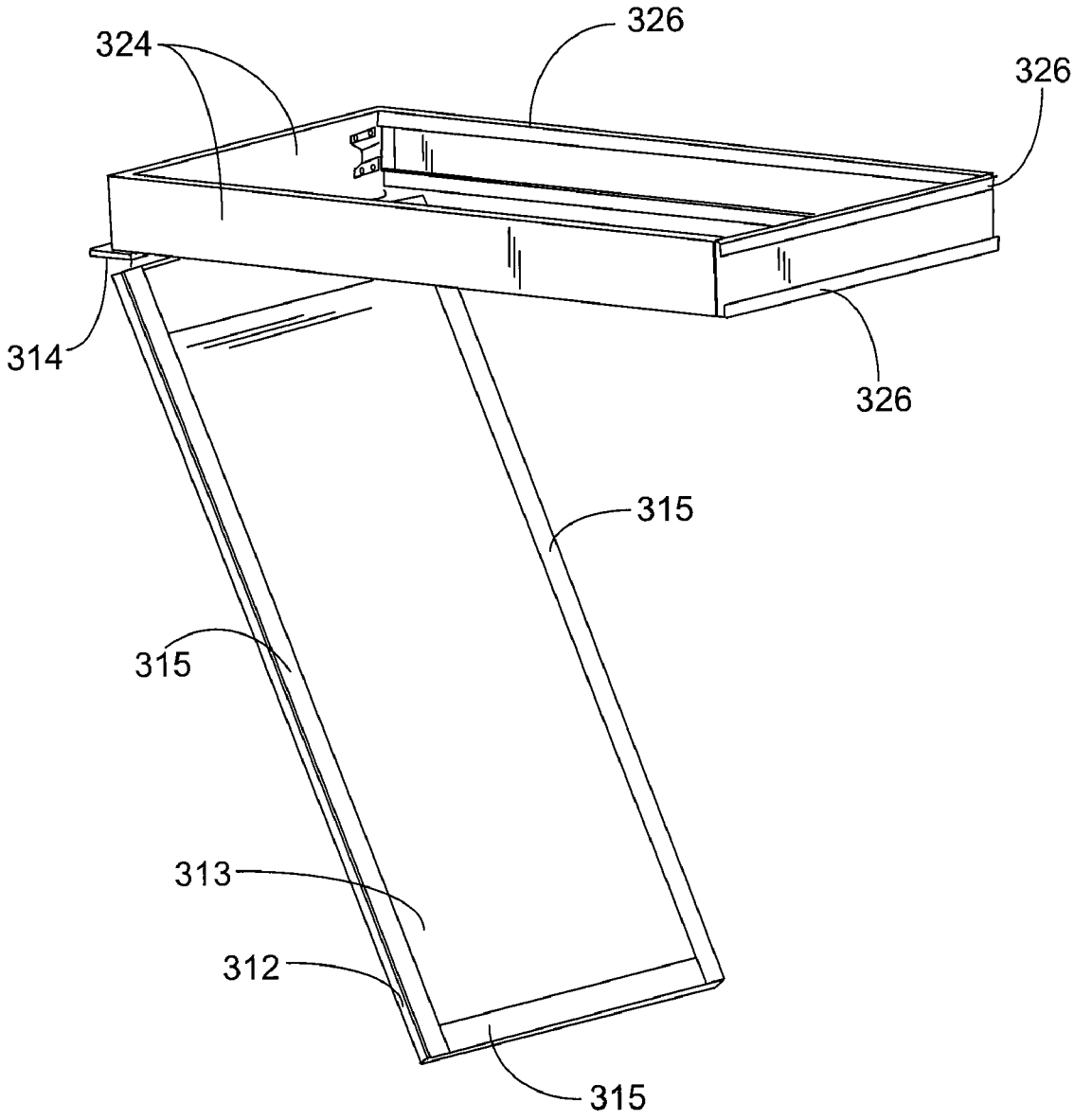
FIG. 4 provides a front profile view of the frame and platform door of an inventive stairway in an open position.

FIG. 4 depicts the platform door 312 and frame 324 alone without any stairway present. In this mariner, one can see how the metal housing 315 is applied around the perimeter of the platform door 312, particular the upper portion 313. The hinge 314, as noted previously, allows for opening and closing of the platform door 312 and connects the door 312 to the frame 324. The periphery of the walls of the frame 324 may also be enveloped with a metal housing 326 (steel, preferably) to permit sealing with the joists of the ceiling (110 of FIG. 2). The frame 324 (again, also referred to as the stairway well sides) must be installed and sized to the degree that the gap between the ceiling joists and the frame walls thereof is at most one-eighth of an inch (⅛") wide. In this manner, a proper flame retardant caulk sealant may be properly applied to the subject frame walls and/or joist surfaces to effectuate the desired barrier to flame and/or fire as for all of the other component parts discussed above. As noted, the weakest link of fire and/or flame protection will contribute to the undesired possibility of heat and/or flame transfer through the subject stairway assembly. A proper caulk applied within this particularly required narrow gap will alleviate these concerns as well. Such a sealant caulk may be SUPER CALSTIK® from IIG, although any other type of flame retardant caulk and sealant will function in this capacity, too. Thus, this caulk may be applied to the frame walls, including the metal housings present thereon.

Figure 3:
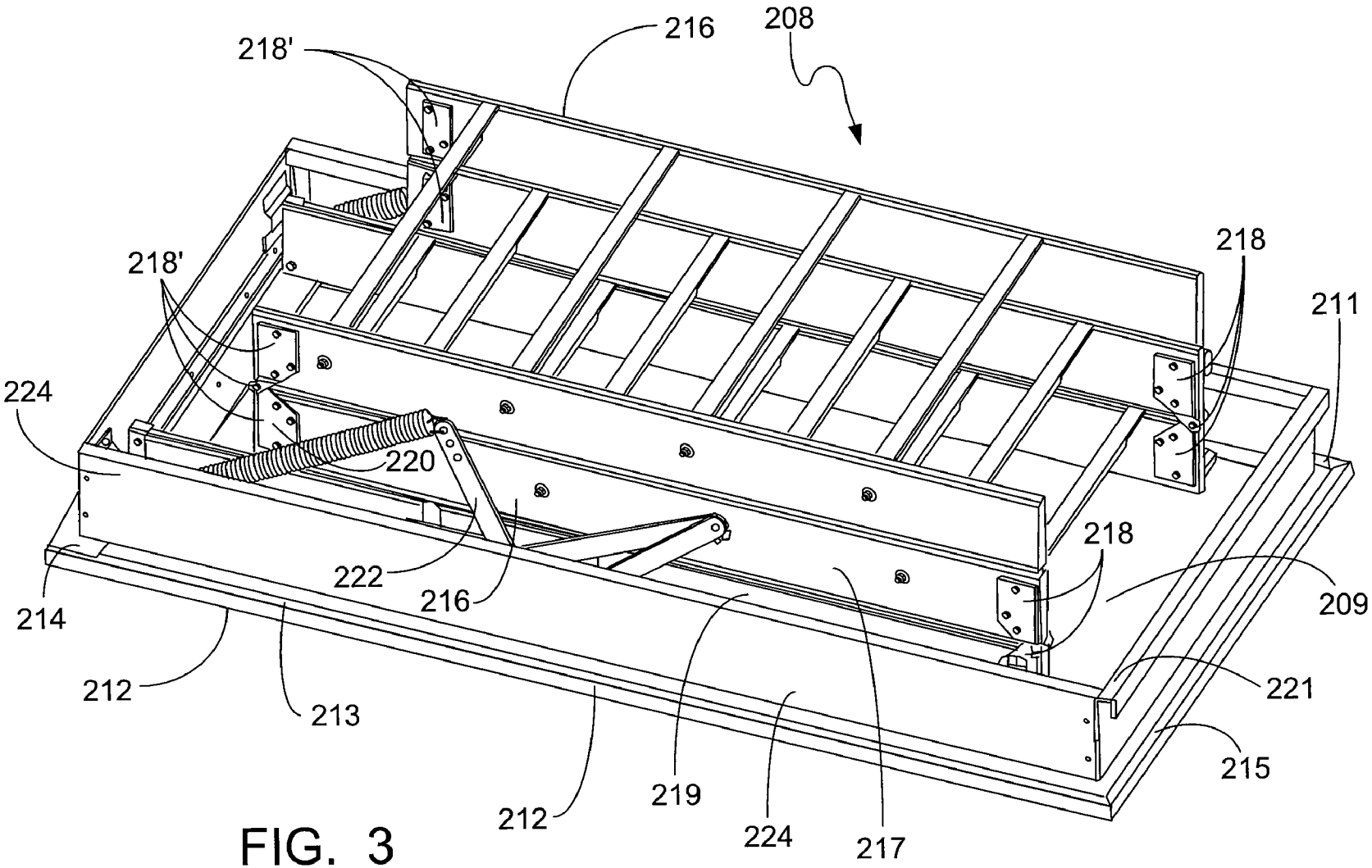
FIG. 3 provides a top profile view of the closed position foldable stairway (in a pre-installed state).

FIG. 3 thus provides a view of the stairway assembly 208 in its pre-installed state. The three stair sections 216, 217, 219 are present folded one on another, with the hinge sets 218, 219 moved in relation to such a folded state. The springs 220 are in relaxed state and the toggle joists 222 are bent to permit the closing state as well. The stair sections 216, 217, 219 all rest upon the platform door 209 comprised of the two portions noted above (not illustrated in this figure), the periphery of which is enveloped in a metal housing 214, 215 for effective sealing and as a barrier to heat and/or flame transfer around the periphery of the ceiling openings (not illustrated) when installed and in closed position. The frame 224 is preferably a steel construction and wrapped with a ceramic paper as noted above, and includes a further steel housing 221 as noted above in certain areas to aid in attachment to wall joists (via nails, screws, or any other like fastening device or article) and for heat and/or flame resistance. The piano hinge 211 is present to eventually pei nit movement between the open and closed position as well.

Taken in combination, all of these critical elements provide an effective barrier to heat and/or flame transfer between building levels when in a closed position, as well as a sufficiently lightweight assembly for easy installation, and simultaneous resiliency to function properly as a weight-bearing stairway, and to withstand the repeated and continuous high-tension openings and closings as well. When subjected to ASTM Test Method E119, the stairway assembly including the preferred materials noted above exhibited at least one full hour of fire resistance, a result, coupled with the other characteristics noted above that was highly surprising. The preferred stairway assembly likewise exhibits a weight of about 170 pounds (about 384 kilograms), thereby facilitating installation thereof within a subject residence.

The inventive foldable stowing stairway (which may also be described as a ladder for purposes of this invention) may be of any typical dimensions to match the dimensions of a typical attic ceiling cut-out within a residence. Such measurements are usually from 22 inches (55.9 cm) to 30 inches (76.2 cm) in width and a maximum of about 60 inches (1.52 m) in length. The stairway itself may be of any height to reach from the subject ceiling to the floor of the lower level in a way to have the bottom of the lower stair section (10 of FIG. 1) contact the floor at an angle to place the stairway in proper position for climbing. The angle should be from 64 to 66° from the ceiling and a ceiling height under 12 feet (3.66 m) to meet this angle requirement.

The invention is not intended to be limited to the preferred versions of the invention described above, but rather is intended to be limited only by the claims set out below. Thus, the invention encompasses all different versions that fall literally or equivalently within the scope of these claims.

We claim:

1. A foldable stowing stairway comprising 1) at least three stair sections, each connected to another via a hinge, and 2) a platform door upon which said at least three stair sections are placed upon when said stairway is in stowed position, said platform door being rectangular in shape with four edges thereof, each edge having a periphery thereof, wherein on one edge is attached a hinge, and wherein each of the remaining three edges having a gasket material applied to the periphery thereof; wherein said platform door comprises at least two different sheet materials, such that at least one of said at least two different sheet materials is a fiber-reinforced cement panel comprising crystalline silica, hydrated calcium silicate, and cellulose fibers and another of at least one of said at least two different sheet materials is a flame and fire resistant panel comprised of calcium silicate, aluminum silicate, crystalline silica, and cellulose or other like fiber, and wherein said flame and fire resistant panel is of a thicker construction than said cement panel; wherein said stairway is of a weight to facilitate installation within a building; and wherein said stairway exhibits at least one hour of fire resistance when tested under ASTM Test Method No. E119 (2007).

2. The foldable stowing stairway of claim 1 wherein when said stairway is installed within a cut-out portion of the ceiling of a subject building, wherein said cut-out portion has the same shape as said platform door, but with a size slightly larger than said platform door, wherein said edges of said platform door are in contact with said ceiling in sealed relation thereto to prevent heat and/or flames from transferring through any gaps between said cut-out portion and said platform door.

3. The foldable stowing stairway of claim 1 wherein said at least two sheet materials within said platform door can withstand a temperature of at least 400° F. (204.4° C.) for at least 1 hour of exposure thereto.

4. The foldable stowing stairway of claim 1 wherein said stairway includes a frame portion having four walls configured in a rectangular shape encompassing said at least three stair section when in stowed position, said four walls constructed of a material that can withstand temperatures of at least 1700° F. (927° C.).

5. The foldable stowing stairway of claim 4 wherein said materials of said four walls are selected from the group consisting of steel, wrapped steel, coated steel, wrapped wood, coated wood, and any combination thereof.

6. The foldable stowing stairway of claim 1 wherein said stairway is attached to a spring device to permit opening and stowing.

7. The foldable stowing stairway of claim 2 wherein all of the contact points between said stairway and said cut-out portion of said ceiling are sealed.

8. The foldable stowing stairway of claim 2 wherein said at least two sheet materials within said platform door can withstand a temperature of at least 400° F. (204.4° C.) for at least 1 hour of exposure thereto.

9. The foldable stowing stairway of claim 2 wherein said stairway includes a frame portion having four walls configured in a rectangular shape encompassing said at least three stair sections when in stowed position, said four walls constructed of a material that can withstand temperatures of at least 1700° F. (927° C.).

10. The foldable stowing stairway of claim 9 wherein said materials of said four walls are selected from the group consisting of steel, wrapped steel, coated steel, wrapped wood, coated wood, and any combination thereof.

11. The foldable stowing stairway of claim 10 wherein said stairway is attached to a spring device to permit opening and stowing.

12. A building or edifice having installed therein said foldable stowing stairway of claim 1.

13. A building or edifice having installed therein said foldable stowing stairway of claim 4.

* * * * *